US006123348A

United States Patent [19]

Miller

[11] Patent Number: 6,123,348

[45] Date of Patent: Sep. 26, 2000

[54] BRAKE SYSTEM FOR DOWNHILL WHEELED BOARD

[75] Inventor: Shawn T. Miller, St. Paul, Minn.

[73] Assignee: M & R Innovations, LLC, Golden Valley, Minn.

[21] Appl. No.: 09/034,579

[22] Filed: Mar. 4, 1998

Related U.S. Application Data

[63] Continuation-in-part of application No. 08/768,294, Dec. 17, 1996, Pat. No. 5,868,408.

[51] Int. Cl.[7] ..... B62M 1/00; A63C 1/24; B60T 1/00; F16D 51/00

[52] U.S. Cl. ..... 280/87.042; 280/11.28; 188/22; 188/77 W

[58] Field of Search ..... 280/87.042, 842, 280/11.28, 11.3, 11.31, 87.041; 188/19, 22, 2 D, 77 R, 77 W

[56] References Cited

U.S. PATENT DOCUMENTS

| | | | |
|---|---|---|---|
| 1,018,512 | 2/1912 | Mees | 280/87.042 |
| 1,603,529 | 10/1926 | Faust . | |
| 2,545,543 | 3/1951 | Bottrill | 280/11.23 |
| 2,572,133 | 10/1951 | Glenn | 280/87.042 |
| 2,899,209 | 9/1959 | Reynolds et al. | 280/11.2 |
| 2,953,389 | 9/1960 | Green et al. | 280/87.04 |
| 3,288,251 | 11/1966 | Sakwa | 188/29 |
| 3,389,922 | 6/1968 | Eastin | 280/11.23 |
| 3,436,088 | 4/1969 | Kunselman | 280/11.1 |
| 3,522,951 | 8/1970 | Tyson | 280/11.1 |
| 3,545,779 | 12/1970 | Simms | 280/11.28 |
| 3,684,305 | 8/1972 | McDonald et al. | 280/11.19 |
| 3,767,220 | 10/1973 | Peterson | 280/11.2 |
| 3,884,486 | 5/1975 | Wilje | 280/11.2 |
| 3,926,449 | 12/1975 | Wilje | 280/11.23 |
| 3,945,655 | 3/1976 | Banks et al. | 280/11.2 |
| 4,045,046 | 8/1977 | Taylor et al. | 280/87.04 A |
| 4,050,705 | 9/1977 | Kreis | 280/11.1 BT |
| 4,055,234 | 10/1977 | Burton | 280/87.042 |
| 4,070,065 | 1/1978 | Heitfield | 301/5.3 |
| 4,076,266 | 2/1978 | Krausz | 280/87.04 A |
| 4,082,306 | 4/1978 | Sheldon | 280/87.04 A |
| 4,133,546 | 1/1979 | Rosenblum | 280/11.1 BT |
| 4,134,600 | 1/1979 | McDonald et al. | 280/87.04 A |
| 4,142,732 | 3/1979 | Boyd | 188/77 R |
| 4,176,850 | 12/1979 | Johnson | 280/87.04 A |
| 4,181,316 | 1/1980 | Brand et al. | 180/87.042 |
| 4,183,546 | 1/1980 | Hellig | 280/87.042 |
| 4,700,958 | 10/1987 | Volpato | 280/11.1 BT |
| 4,943,075 | 7/1990 | Gates | 280/842 |
| 4,951,958 | 8/1990 | Chao | 280/87.042 |
| 5,020,621 | 6/1991 | Martin | 280/87.042 |
| 5,114,166 | 5/1992 | McCosker | 280/87.042 |
| 5,125,687 | 6/1992 | Hwang | 280/842 |
| 5,135,244 | 8/1992 | Allison | 280/11.28 |
| 5,195,781 | 3/1993 | Osawa | 280/842 |
| 5,251,934 | 10/1993 | Gates | 280/842 |
| 5,263,725 | 11/1993 | Gesmer et al. | 280/87.042 |
| 5,390,943 | 2/1995 | Hedrick | 188/77 R |
| 5,501,304 | 3/1996 | Fini, Jr. | 188/77 R |
| 5,924,328 | 6/1999 | Okajima et al. | 188/2 D |

*Primary Examiner*—Lanna Mai
*Assistant Examiner*—Jeffrey J. Restifo
*Attorney, Agent, or Firm*—Kinney & Lange, P.A.

[57] ABSTRACT

A brake system slows and/or stops a downhill wheeled board for simulating snowboarding on a snowless terrain. The downhill wheeled board includes a platform having a top and a bottom; at least a first wheel, a second wheel and a third wheel, each wheel having an independent suspension and rotationally mounted to the bottom of the platform for rotation about an axis of rotation; and a brake system. The brake system for the downhill wheeled board includes a control mechanism such as a hand-held trigger, a force splitter such as a Y-plate, a first brake for braking the first wheel and a second brake for braking the second wheel. The force splitter is coupled to the control mechanism for movement by movement of the control mechanism. The first brake is coupled by a first flexible coupling to the force splitter and the second brake is independently coupled to the force splitter. By having a flexible coupling, the independent suspension of the wheels does not affect braking. Thus, movement of the force splitter activates both the first brake and the second brake.

16 Claims, 5 Drawing Sheets

BRAKE SYSTEM FOR DOWNHILL WHEELED BOARD

CROSS-REFERENCE TO RELATED APPLICATION(S)

This application is a continuation-in-part of application Ser. No. 08/768,294, filed Dec. 17, 1996, which issued as U.S. Pat. No. 5,868,408 on Feb. 9, 1999.

BACKGROUND OF THE INVENTION

The present invention relates to a downhill board with wheels for simulating snowboarding in snowless conditions. More specifically, the present invention relates to a brake system for a downhill wheeled board having specialized suspension and wheels for use on vegetated or otherwise snowless terrain.

The sport of snowboarding has achieved immense popularity over the past several years. Similar to downhill skiing, snowboarding typically takes place at a downhill ski slope, with the "snowboarder" riding or otherwise maneuvering the snowboard down a snow-covered hill. A standard snowboard includes a single platform to which two bindings are attached. The platform is normally made from fiberglass reinforced plastic and is customized in size and shape. These shapes can include sharp edges to effectuate turns, and a curvature of some type on the bottom of the platform to provide a smooth ride.

Snowboarding is a winter sport unique unto itself in that both feet of the snowboarder are held on a single board, as opposed to two individual skis. However, snowboarding does have one key similarity with downhill skiing. Namely, both snowboarding and skiing require snow. The standard snowboard has a basically flat bottom which will not slide on a rough surface. Therefore, a snowboarder is unable to practice or simulate snowboarding in the summer time or at locations where there is no snow.

Skateboards are somewhat similar to snowboards in that a user places both feet on a single platform. A standard skateboard includes two sets of wheels attached to the bottom of the platform. The user simply propels the platform so that the wheels ride along a sidewalk or other hard surface. Therefore, it may, at first glance, appear as though a standard skateboard could be ridden down a snowless hill so that snowboarding could be practiced without snow. However, the skateboard has many design constraints which prevent it from being a viable vehicle for snowboarding in the summer months.

A typical skateboard does not include bindings. Thus, when attempting to "ride" a skateboard down a hill, any slight loss of balance will cause the user to fall off. Further, hills, when not covered with snow, often include rough terrain, such as grass, sticks, small rocks, etc. The standard skateboard design cannot encounter and ride over many of these terrain obstacles. For example, the wheel design of a skateboard is made for riding along a relatively smooth surface, such as a paved road. When the rough terrain of a snowless ski slope is encountered, the skateboard wheel integrity may deteriorate, resulting in severe damage to both the skateboard and possibly the rider.

The same is true with respect to the suspension system. The normal skateboard simply bolts a central bracket of the wheel assembly to the platform with little thought to suspension. If a user were to ride a skateboard down a snowless ski slope, any obstacles encountered would transfer a force or "jolt" to the rider, likely causing the user to fall off.

Finally, the skateboard platform is normally low to the ground due to a low wheel height. As a result, the platform would often run directly into many obstacles, once again causing a fall.

Thus, because avid snowboarders desire to practice their skills in the summer time or at locations where there is no snow, a need exists for a downhill wheeled board which is specially designed to handle the harsh terrain of a snowless ski slope, thus simulating snowboarding. The invention of downhill wheeled boards have made it possible to replicate the sport of snowboarding in snowless conditions. The downhill wheeled board may be designed as further shown in Applicant's co-pending application Ser. No. 08/768,294, filed Dec. 17, 1996, incorporated herein by reference, and available as TURF BOARD™ downhill wheeled boards from M & R Innovations, LLC. of Plymouth, Minn.

Skateboarders typically slow and/or stop due to frictional slowing over a relatively horizontal surface and/or by jumping off the board. In downhill wheeled boarding, a relatively horizontal surface is not generally available. Additionally, because bindings are typically used in downhill wheeled boarding, jumping off the board is difficult, particularly while traveling at a high speed.

In snowboarding and skiing, slowing and stopping on a slope is common. Similar to skiing, to slow and/or stop a snowboard the rider usually turns the snowboard at an angle to the direction of travel and balances on the snowboard such that the trailing edge of the snowboard digs into the underlying snow passing transversely under the trailing edge. In contrast, in downhill wheeled boarding the board itself does not contact the underlying terrain. Without edge contact, a snowboarding or skiing type of stop cannot be obtained on a downhill wheeled board. Another mechanism is needed in order to allow the rider to have adequate slowing and stopping control over the downhill wheeled board.

BRIEF SUMMARY OF THE INVENTION

The present invention is a brake system for a downhill wheeled board for simulating snowboarding on a snowless terrain. The downhill wheeled board includes a platform having a top and a bottom. At least a first wheel, a second wheel and a third wheel are rotationally mounted to the bottom of the platform. Each wheel has an independent suspension. The downhill wheeled board has a brake system which includes a control mechanism such as a hand-held trigger, a force splitter such as a Y-plate, a first brake for braking the first wheel and a second brake for braking the second wheel. The force splitter is coupled to the control mechanism for movement by movement of the control mechanism. The first brake is coupled by a first flexible coupling to the force splitter and the second brake is independently coupled to the force splitter. Movement of the force splitter activates both the first brake and the second brake. By having a flexible coupling, the independent suspension of the wheels does not affect braking.

Figure 1:
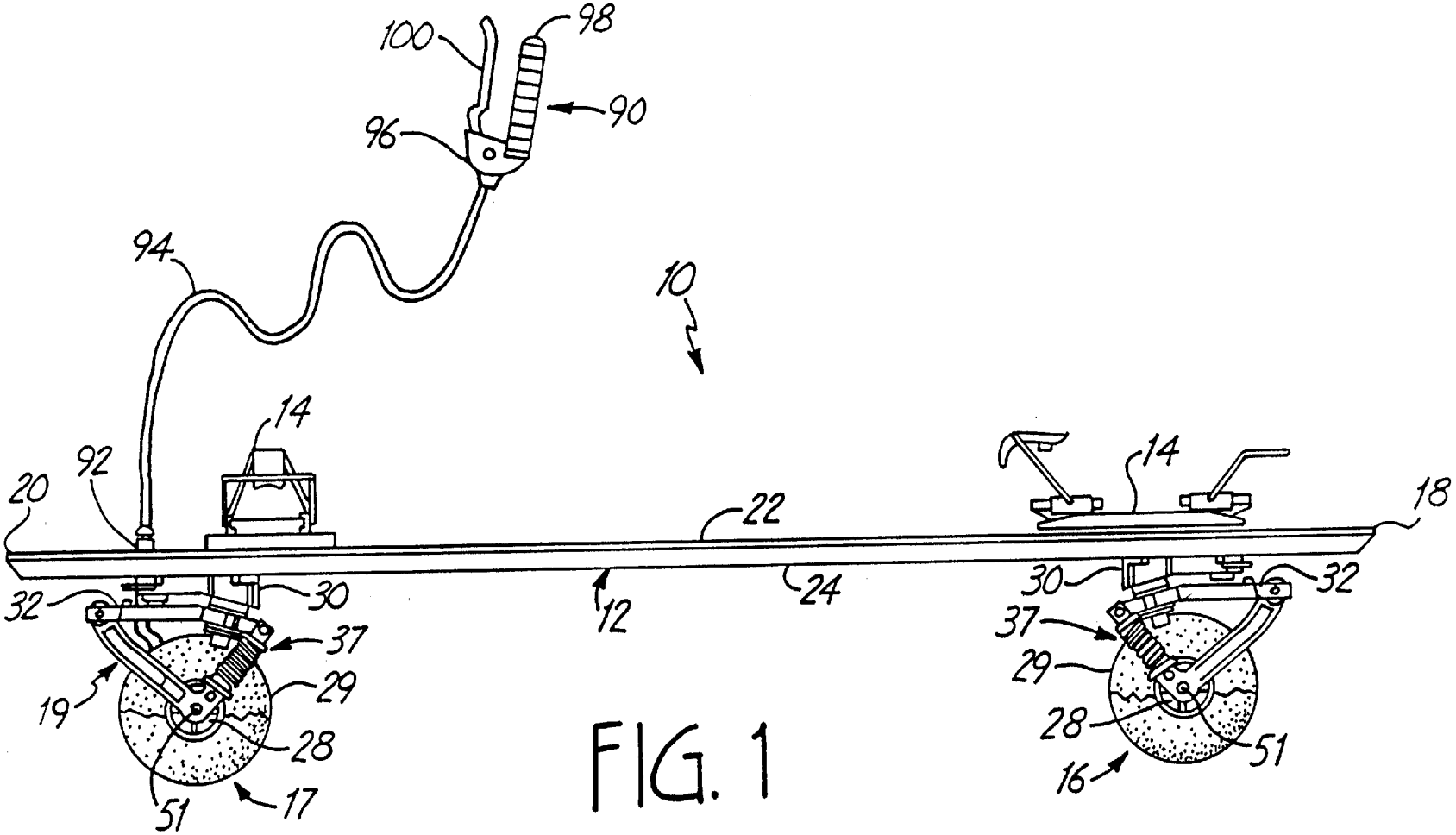
FIG. 1 is a side view of the downhill wheeled board of the present invention.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Generally, a downhill wheeled board 10 of the present invention includes a platform 12, bindings 14, a front wheel assembly 16, a rear wheel assembly 17 and a brake system 19. The platform 12, which is similar in design and shape to boards commonly used for snowboarding, includes a front end 18, a rear end 20, a top surface 22 and a bottom surface 24. The platform 12 is preferably formed from fiberglass reinforced plastic, although, as will be obvious to those skilled in the art, a variety of other materials, such as wood, fiberglass reinforced wood, metals and composite materials may also be used. The dimensions of the platform 12 may be varied according to the size, weight and boarding style of a user of the downhill wheeled board 10. While the platform 12 is shown as being relatively flat, the platform 12 can be designed to effectuate a bend at the front end 18 and the rear end 20. For example, the front end 18 and the rear end 20 can be manufactured separately, with a middle section disposed between the front end 18 and the rear end 20, at a position several inches below a common plane of the front end 18 and the rear end 20.

The bindings 14 may be of any type known in the art and may be similar to those bindings commonly used in snowboarding. The bindings 14 are positioned on the platform 12 and connected to the top surface 22 in any suitable manner, such as by bolting. As shown in FIG. 1, the bindings 14 are generally located above the front wheel assembly 16 and the rear wheel assembly 17. As is commonly known in the sport of snowboarding, the bindings 14 secure the platform 12 to a user of the downhill wheeled board 10. Alternatively, the bindings 14 of FIG. 1 can be replaced by simple straps. Even further, the bindings 14 can be removed and the top surface 22 of the platform 12 roughened or otherwise textured to frictionally maintain contact with a user's feet.

As shown in FIG. 1, the front wheel assembly 16 and the rear wheel assembly 17 are attached to the bottom surface 24 of the platform 12. The front wheel assembly 16 and the rear wheel assembly 17 are preferably identically constructed. The front wheel assembly 16 is attached to the bottom surface 24 of the platform 12 near the front end 18, and the rear wheel assembly 17 is attached to the bottom surface 24 of the platform 12 near the rear end 20 in an opposing fashion. In other words, the front wheel assembly 16 is orientated opposite the rear wheel assembly 17.

The front wheel assembly 16 may be mounted for free rotation and need not include the brake system 19. Alternatively, the brake system 19 may be used on the front wheel assembly 16 in conjunction with or in substitution for the brake system 19 for the rear wheel assembly 17.

Both the front wheel assembly 16 and the rear wheel assembly 17 preferably have bi-lateral symmetry. That is, each wheel assembly preferably includes two wheels 28, with a tire 29 mounted on each of the wheels 28. Alternatively, either the front wheel assembly 16 or the rear wheel assembly 17 may have a different number of wheels 28. Generally speaking, at least three wheels 28 are preferred for the downhill wheeled board 10, so the board 10 has a spread base to more easily maintain a flat balanced orientation as it rides over terrain.

The front wheel assembly 16 and the rear wheel assembly 17 are uniquely designed to provide a durable suspension system for the user of the downhill wheeled board 10. During use, one wheel 28 can move upward with respect to the platform 12, for example in response to an obstacle, while the other wheels 28 remain in full contact with the ground. Preferably each of the wheels 28 has an independent suspension 37 which allows the wheel 28 to move relative to the platform and relative to the other wheels 28. By having the independent suspension 37 for each wheel 28, the downhill wheeled board 10 is better able to maintain consistent contact with terrain under each of the wheels 28. Thus, the wheels 28 can encounter a wide variety of severe terrain with minimal impact on the platform 12, and thus the user.

Figure 2:
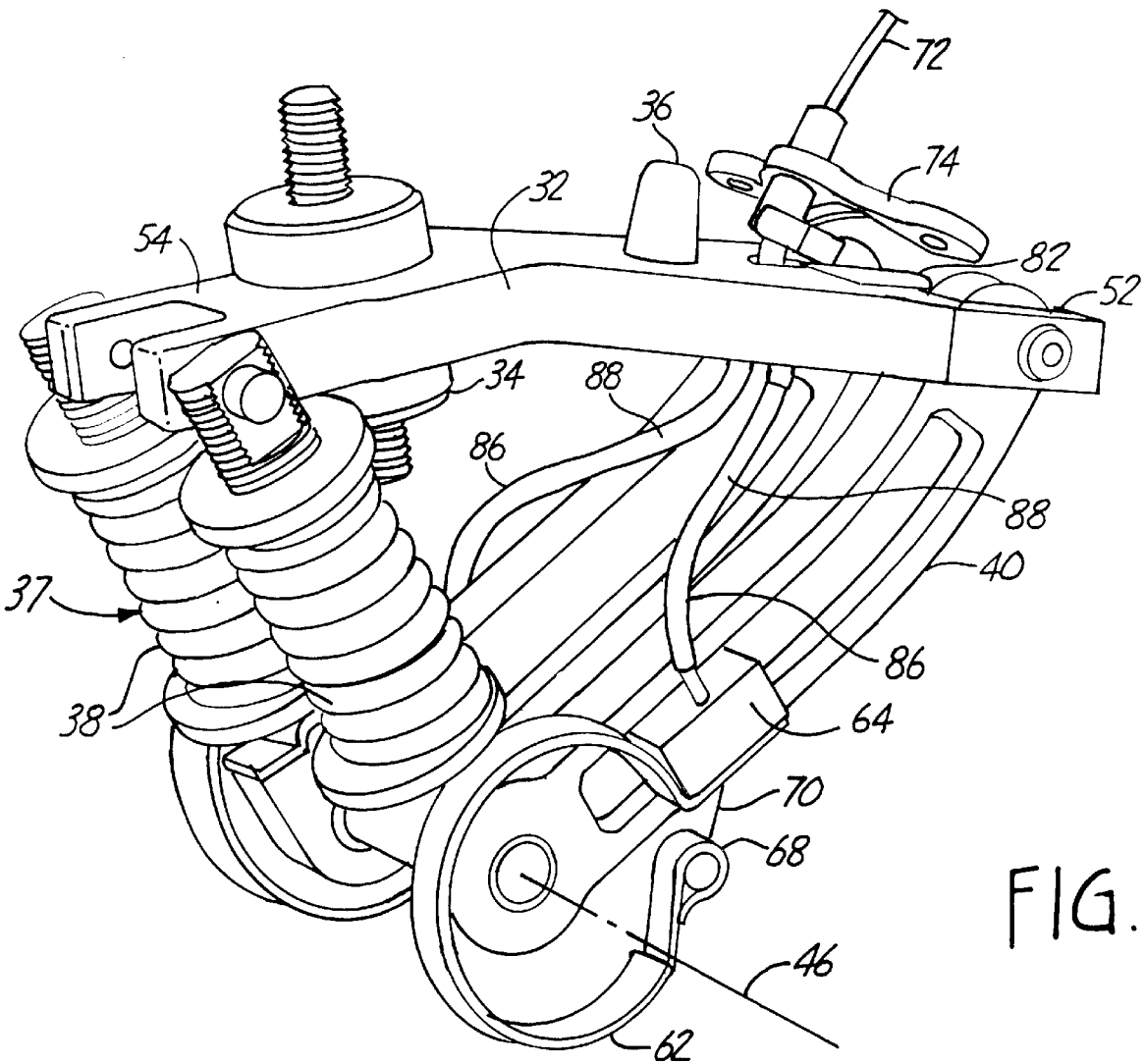
FIG. 2 is a perspective view from a forward angle of the rear suspension including the brake system of the present invention.
Figure 3:
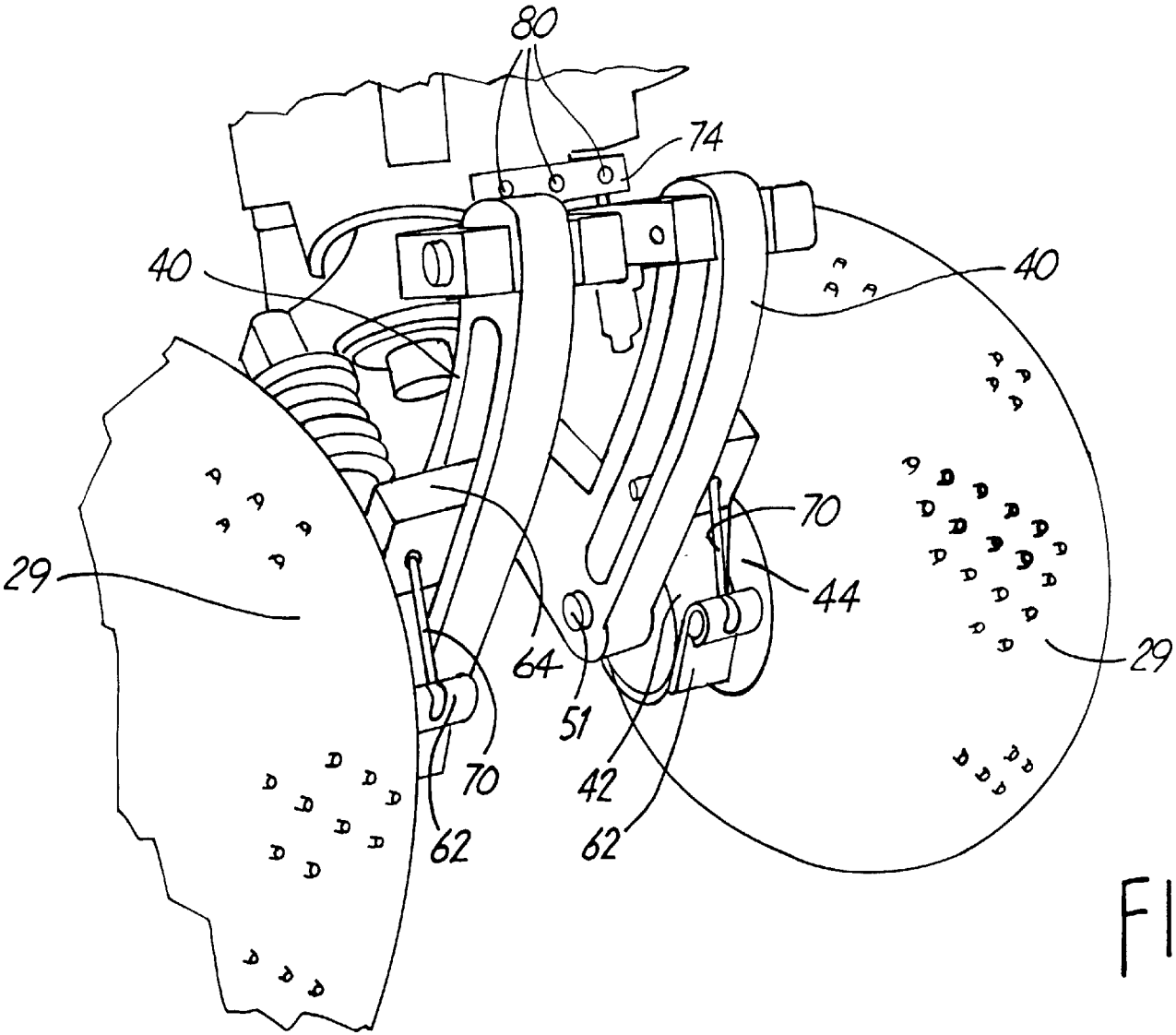
FIG. 3 is a perspective view from a rearward angle of the rear wheel assembly and the rear suspension including the brake system of the present invention.
Figure 4:
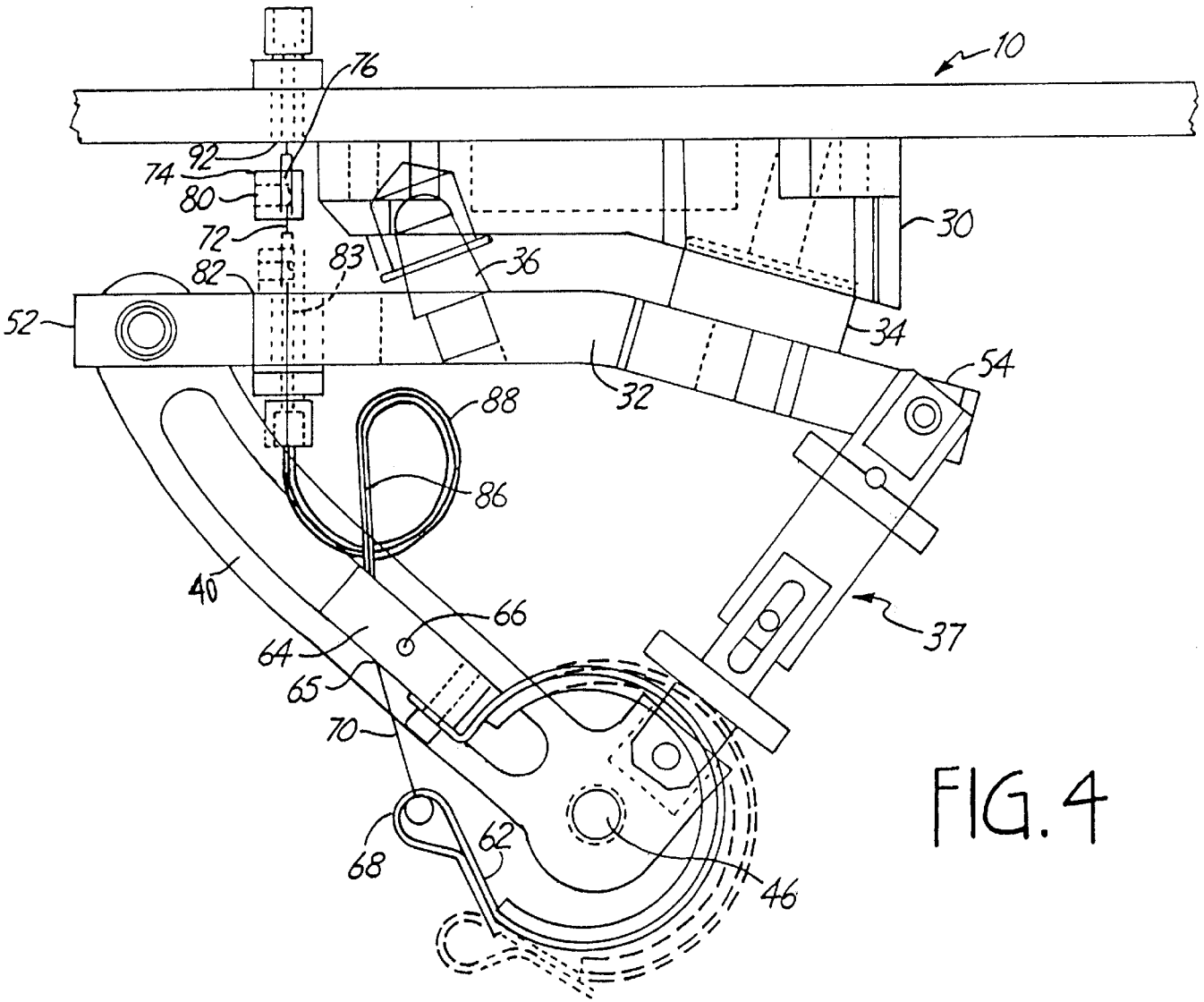
FIG. 4 is a side view in cross section of the rear suspension including the brake in active position in solid lines and the brake in inactive position in dashed lines.

FIGS. 2–4 show the rear wheel assembly 17 in greater detail. To more clearly depict the rear wheel assembly 17, the bindings 14 and platform 12 are not shown in FIGS. 2 and 3. As best shown in FIGS. 2 and 4, the rear wheel assembly 17 includes a base plate 30, a hinge plate 32, a truck assembly 34 and a spud assembly 36. The rear wheel assembly 17 also includes the independent suspension 37 for each wheel 28 and the tire 29 mounted to each wheel 28. The base plate 30 is secured to the bottom surface 24 of the platform 12, preferably by bolting. However, other forms of attachment are equally acceptable.

The base plate 30 is connected to the hinge plate 32 by the truck assembly 34 and the spud assembly 36. Further details with regard to the truck assembly 34 and the spud assembly 36 are discussed in Applicant's co-pending application Ser. No. 08/768,294, filed Dec. 17, 1996, incorporated herein by reference. The truck assembly 34 and the spud assembly 36 provide a user with control over the downhill wheeled board 10 in that the user can transfer a turning motion by leaning toward an edge of the platform 12. This directional force is transposed through the truck assembly 34 and the spud assembly 36 to the hinge plate 32 and subsequently to the wheels 28. The hinge plate 32 includes a hinge end 52 and a suspension end 54.

Each independent suspension 37 includes a spring assembly 38 and a lever arm 40. Each lever arm 40 is pivotally attached to the hinge end 52 of the hinge plate 32. Each spring assembly 38 is attached to and biases off the suspension end 54 of the hinge plate 32. Each lever arm 40 is connected to its corresponding wheel 28 and its corresponding spring assembly 38. The lever arm 40 is preferably an I-shaped beam to support more load without adding unnecessary weight to the suspension. Each of the wheels 28 may independently pivot about a pivot point by compression of the spring assembly 38.

Each of the wheels 28 is rotationally mounted to its lever arm 40, for rotation about a generally horizontal axis of rotation 46. For instance, each of the wheels 28 may be mounted on a hub 42 which inwardly extends from the wheel 28 and rotates with the wheel 28 about the axis of rotation 46. When the independent suspension 37 is used for the wheel 28, such as going over a bump in the terrain, the axis of rotation 46 moves relative to the bottom surface 24 of the platform 12 and relative to the other wheels 28. As best shown in FIG. 4, the hub 42 includes an outer frictional surface 44, and may be provided of metal such as aluminum or aluminum alloys.

The lever arm 40 and the spring assembly 38 are preferably disposed in an identical vertical plane. The front wheel assembly 16 and the rear wheel assembly 17 are designed to withstand large impacts. For example, the user can land after a four foot drop with no damage to the front wheel assembly 16 and the rear wheel assembly 17. The spring assembly 38 and the truck assembly 34 absorb the majority of such an impact. By connecting each of the lever arms 40 directly to the hinge plate 32 and the spring assembly 38, resulting stresses on a central wheel axle 51 are minimized. This effect is further enhanced by positioning the spring assembly 38 and the lever arm 40 in a similar vertical plane. Further, the hinge plate 32 helps to isolate the base plate 30 and the platform 12 from the wheels 28.

The brake system 19 includes an independent brake for each braked wheel. For instance, the preferred brake includes a brake band 62 which extends circumferentially around the hub 42 of the wheel 28. During use of the brake system 19, the brake band 62 frictionally engages the outer frictional surface 44 of the rotating hub 42 to slow the rotation of the wheel 28.

The brake band 62 may be formed of a strong cloth, such as woven nylon, or more preferably is formed out of a bearing metal such as oil impregnated bronze. By forming the brake band 62 of metal, it may exert a spring force against circumferential tightening on the hub 42. If desired, the brake band 62 may be lined with a frictional brake lining material similar to brake linings used for automobiles. In any event, the brake band 62 is preferably resistant to wear, but is significantly softer than the hub 42 material so wear occurs to the brake band 62 rather than to the hub 42. During use of the downhill wheeled board 10, the brake bands 62 should be periodically checked for wear and should be replaced before any possible failure.

The preferred brake band 62 extends nearly 360° around the hub 42, including covering all of the front or "upstream" side of the hub 42 considering the direction of travel of the downhill wheeled board 10. The opening between the ends of the brake band 62 occurs on the rear or downstream side of the hub 42. Because the brake band 62 covers the entirety of the upstream side of the hub 42, vegetation and debris which contacts the brake band 62 will in nearly all instances be pushed aside by the brake band 62 and will not enter the space between the brake band 62 and the hub 42. Because the opening between the ends of the brake band 62 occurs on the downstream side, vegetation and debris will generally not enter the opening. Because the brake band 62 has a significant circumferential length of frictional contact when activated, even if some vegetation or debris enters the space between the brake band 62 and the hub 42, the brake still works satisfactorily to slow and/or stop the wheel 28.

The brake band 62 is mounted relative to each wheel 28 for travel with the independent suspension 37 of that wheel 28. For instance, the brake band 62 may affixed to the lever arm 40 by a brake band bracket or block 64. The block 64 is preferably sized to be received between the flange portions of the I-shaped lever arm 40. Being received by the lever arm 40 in this fashion not only aids in assembly, but also helps to secure the block 64 to the lever arm 40 and transfer stress between the block 64 and the lever arm 40. The block 64 may include several screw holes 66, and may be rigidly secured to the lever arm 40 such as by bolts. Thus the brake is on the suspension of the wheel 28 which it brakes and moves with the wheel 28. Because the brake band 62 is afflixed to the lever arm 40, the brake band 62 will travel with the hub 42 whenever the wheel 28 hits a bump and uses its independent suspension 37.

A free end 68 of the brake band 62 not affixed to the block 64 includes an attachment to a brake cable 70. As best shown in FIG. 4, the brake band 62 is circumferentially tightened around the hub 42 by pulling upwardly on the brake cable 70. That is, pulling upwardly on the brake cable 70 causes the brake band 62 to circumferentially tighten and frictionally engage the hub 42, slowing and/or stopping the rotation of the wheel 28.

In the preferred embodiment, the brake cable 70 extends through a cable guide hole 65 in the block 64 for proper alignment to the free end 68 of the brake band 62. The block 64 thus serves a dual purpose of securing the brake band 62 to the lever arm 40 and receiving and aligning the brake cable 70 relative to the brake band 62.

Figure 5:
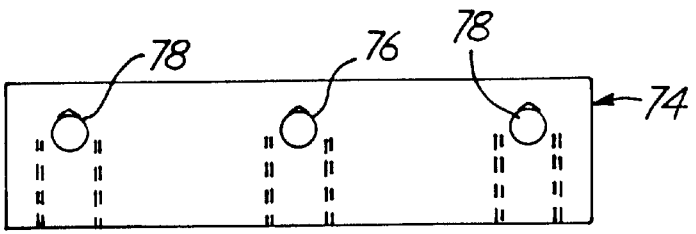
FIG. 5 is a plan view of a Y-plate of the present invention.
Figure 6:
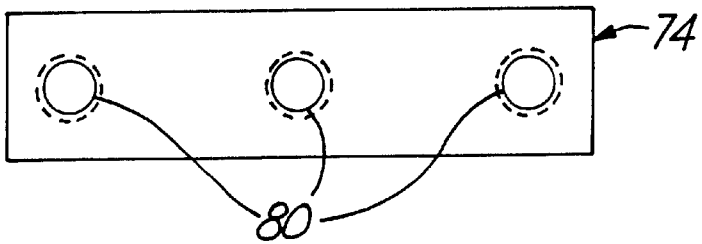
FIG. 6 is a rear view of the Y-plate of the present invention.

The two brake cables 70 (one for each independently suspended wheel 28) are jointly operated by attachment to a control cable 72 through a force splitter. The preferred force splitter is a Y-plate 74 as best shown in FIGS. 5 and 6. To operate the brake as shown in FIG. 4, the individual brake cables 70 attached to the Y-plate 74 are pulled axially when the Y-plate 74 raises from the hinge plate 32. The Y-plate 74 preferably includes a control cable through hole 76 for receiving the control cable 72, and two brake cable through holes 78 for receiving the two brake cables 70. The two brake cable through holes 78 should be equally spaced and at opposing sides of the control cable through hole 76. For instance, the Y-plate 74 preferably includes equal separation distances between the control cable through hole 76 and each of the brake cable through holes 78 of about ½ to ¾ of an inch. With this equal separation distance, the tension force of the two brake cables 70 is equally balanced against the tension force of the control cable 72.

The control cable 72 and the two brake cables 70 are preferably releasably secured to the Y-plate 74. For example, the Y-plate 74 may include threaded holes 80 directed transverse and intersecting each of the through holes. Set screws may be used in each of the threaded holes 80 to tighten and secure each of the control cable 70 and the brake cables 72 to the Y-plate 74. In the preferred embodiment, the set screws face rearward as shown in FIG. 4 on the Y-plate 74, and the Y-plate 74 is located toward the hinge end 52 of the hinge plate 32, allowing easy access to the set screws. By loosening of a set screw, the corresponding cable 70, 72 can be pulled or pushed through its through hole 78, 76 in the Y-plate 74, such that the cable position is changed relative to the Y-plate 74. To facilitate pulling or pushing of the control cable 72 relative to the Y-plate 74 and the platform 12, the control cable 72 may extend for a distance of 3 to 5 inches beyond the control cable through hole 76 in the Y-plate 74. At least during assembly, the two brake cables 70 may also extend for a considerable distance beyond the brake cable through holes 78 in the Y-plate 74. After the adjustment, the set screw may again be tightened down to hold the cable in place relative to the Y-plate 74. The releasable securing of each of the cables 70, 72 to the Y-plate 74 thus allows flexibility in adjusting the tension and position of each of the cables 70, 72. The adjustment can easily be done without removal of or interference by any structure of the independent suspension 37. If the brake cables 70 extend beyond the Y-plate 74 for more than a negligible amount, they may be cut off after adjustment to ensure that they do not interfere with upward movement of the Y-plate 74 during brake activation.

The Y-plate 74 preferably rests on a resting surface 82 such as provided by the hinge plate 32. Each of the brake cables 70 should be adjusted relative to the Y-plate 74 such that each brake band 62 places a set minimum tension in its corresponding brake cable 70 in this inoperative, resting position. The resting surface 82 provides a stop against the minimum tension in the brake cables 70. At least this minimum tension must be overcome by a tension force on the control cable 72 to operate the brake. Conversely, each of the brake cables 70 should be adjusted relative to the Y-plate 74 such that there is minimal clearance between the brake band 62 and the hub 42 in this inoperative, resting position. With this minimal clearance, a small range of travel of the Y-plate 74 will cause frictional engagement between the brake band 62 and the hub 42 and braking of the wheel 28.

In the preferred embodiment, this resting surface 82 is parallel to the platform 12 and perpendicular to the direction of travel of the Y-plate 74 during braking. The resting surface 82 maintains the Y-plate 74 in a horizontal configuration and balances the Y-plate 74 after each braking action. The hinge plate 32 may include two holes 83 extending there through to receive the individual brake cables 70.

Workers skilled in the art will understand that other designs of a force splitter could equivalently be used instead of the Y-plate 74 shown and described. For instance, the force splitter might be merely a cable spliced so it has a joint and separates like a Y. However, the Y-plate 74 provides stopping, balancing and adjustability advantages which a spliced cable would not provide.

Between the hinge plate 32 and the block 64, each of the brake cables 70 is disposed in a brake cable housing 86. The cable guide hole 65 in the block 64 has screw threads to fixedly receive one end of the brake cable housing 86, and the through hole 83 in the hinge plate 32 includes screw threads to fixedly receive the other end of the brake cable housing 86. The brake cable housing 86 allows the brake cable 70 to move axially therein without undue wear on the brake cable 70 as it is being used.

Both the brake cables 70 and the brake cable housings 86 are flexible to allow bending of the brake cables 70. Bending of the brake cable 70 occurs repeatedly each time the independent suspension 37 of the wheel 28 is used, that is, each time the spring assembly 38 is compressed because the wheel 28 goes over a bump. Moreover, the brake cable 70 and the brake cable housing 86 should both be flexible enough so that bending of the brake cable 70 due to motion of the independent suspension 37 does not cause the brake cable 70 to move axially in the brake cable housing 86.

To ensure that the movement of the independent suspension 37 does not cause the brake cable 70 to move axially in the brake cable housing 86, a permanent bend 88 is disposed in the brake cable 70. For instance, the blocks 64 for the two brake cables 70 may be spaced approximately 3 to 6 inches apart, as opposed to the about 1 to 1½ inch spacing between the brake cables 70 at the Y-plate 74. The blocks 64 for the two brake cables 70 may be further be spaced forward or rearward of the Y-plate 74, such as 2 to 4 inches forward of the Y-plate 74. These offsets place the permanent bend 88 in the brake cables 70, including a portion of the permanent bend 88 which extends generally perpendicular to the direction of travel of the independent suspension 37. With this configuration and because of the flexibility of the coupling between the Y-plate 74 and the brake, bouncing of the independent suspension 37 is totally absorbed by bending of the brake cable 70 without any axial movement of the brake cable 70 in the brake cable housing 86 or axial movement of the brake cable 70 relative to the brake band 62. The brake itself is only activated by tension in the control cable 72 and is entirely insulated from and unaffected by the rough terrain encountered during use of the downhill wheeled board 10.

The braking system 19 includes a control mechanism 90 to enable the rider to move the Y-plate 74 such as by pulling the control cable 72. As best shown in FIG. 1, the preferred control mechanism 90 includes the control cable 72 in a control cable housing 94 and a hand-held trigger 96. The control cable housing 94 may be secured to the platform 12. More preferably, the control cable housing 94 terminates in a threaded engagement with a through hole 92 in the rear end 20 of the platform 12. The control cable 72 extends through the through hole 92 to be received by the Y-plate 74 immediately underneath the platform 12. In this position, the Y-plate 74 and the exposed portion of the control cable 72 are both shielded as much as possible from vegetation during riding of the downhill wheeled board 10 and shielded as much as possible from the rider so the rider will not inadvertently interfere with the brake operation.

The trigger 96 pulls the control cable 72 within the control cable housing 94. For instance, the trigger 96 may be designed similar to bicycle brake triggers, and include a short handle bar section 98 and a pivot piece 100. The control cable housing 94 is attached relative to the handle bar section 98, and the control cable 72 is attached to the pivot piece 100. Moving the pivot piece 100 toward the handle bar section 98 pulls the control cable 72 axially relative to the control cable housing 94 to raise the Y-plate 74 off the resting surface 82.

The preferred trigger 96 is hand-held, and both the control cable 72 and the control cable housing 94 are flexible. This allows the rider to control the brake with a simple squeezing of the trigger 96, and still have free movement of his or her hand for balancing on the downhill wheeled board 10. The rider is typically well acquainted with braking by squeezing of a handle bar trigger on a bicycle, and thus the braking motion comes naturally or innately to most riders.

Alternatively or in conjunction with the trigger 96, a second control mechanism (not shown) may be provided to move the control cable 72 axially within the control cable housing 94. For instance, the bindings may include a spring loaded control mechanism which pulls on the brake cable 70 whenever the user pulls out of the bindings 14. Such a binding activated brake system allows the brake to be automatically activated when the user becomes separated from the downhill wheeled board 10, preventing the downhill wheeled board 10 from freely traveling down the slope.

Although the present invention has been described with reference to preferred embodiments, workers skilled in the art will recognize that changes may be made in form and detail without departing from the spirit and scope of the invention.

What is claimed is:

1. A downhill wheeled board comprising:

a platform having a top and a bottom;

at least a first wheel, a second wheel and a third wheel each rotationally mounted to the bottom of the platform, each for rotation about an axis of rotation, wherein at least one of the first, second and third wheels is a front wheel and at least one the first, second and third wheels is a rear wheel, the front wheel being longitudinally spaced along the bottom of the platform from the rear wheel;

a first independent suspension for supporting the first wheel such that its axis of rotation can move relative to the bottom of the platform and relative to the second wheel; and a brake system for the downhill wheeled board, the brake system comprising:

a control mechanism;

a force splitter coupled to the control mechanism for movement by movement of the control mechanism;

a first brake for braking the first wheel, the first brake coupled to the force splitter by a first brake cable in a first brake cable housing, wherein the first brake cable and the first brake cable housing are flexible for bending upon movement of the first wheel relative to the bottom of the platform with a permanent bend in the first brake cable, the permanent bend accepting suspension movement of the first wheel without axial tensioning of the first brake cable in the first brake cable housing; and a second brake for braking the second wheel, the second brake independently coupled to the force splitter, such that movement of the force splitter activates both the first brake and the second brake.

2. The downhill wheeled board of claim 1, further comprising:

a second independent suspension for supporting the second wheel such that its axis of rotation can move relative to the bottom of the platform and relative to the first wheel, and wherein the second brake is coupled to the force splitter by a second flexible coupling, wherein the first wheel and the second wheel are either both front wheels or both rear wheels.

3. The downhill wheeled board of claim 1, wherein the first independent suspension comprises:

a first arm pivotally secured relative to the platform, the first arm having a movable end with the first wheel rotationally secured to the moveable end; and a shock spring for biasing the first arm toward an extended position;

wherein the first brake cable housing terminates in a block, the block secured to the first arm for suspension movement with the first wheel.

4. The downhill wheeled board of claim 3, wherein the block is offset relative to the force splitter thus forming the permanent bend in the first brake cable.

5. The downhill wheeled board of claim 3, wherein the first wheel comprises a hub, and wherein the first brake comprises a brake band mounted for circumferential tightening around the hub upon movement of the force splitter, wherein the brake band is secured to the block for suspension movement with the first wheel.

6. The downhill wheeled board of claim 1, wherein the control mechanism comprises:

a control cable axially movable in a control cable housing, the control cable housing being secured to the platform.

7. The downhill wheeled board of claim 6, wherein the force splitter comprises a Y-plate, with the control cable releasably secured to the Y-plate.

8. The downhill wheeled board of claim 7, further comprising a resting plate spaced below the bottom of the platform, wherein the Y-plate rests on the resting plate when the brake is not activated, and when the control cable is pulled the Y-plate is raised off the resting plate.

9. The downhill wheeled board of claim 8, wherein the first brake is coupled to the force splitter by a first brake cable in a first brake cable housing, and wherein the first brake cable housing is secured to the resting plate.

10. The downhill wheeled board of claim 6, wherein a control cable hole is defined through the platform, and wherein the control cable extends through the control cable hole.

11. The downhill wheeled board of claim 6, wherein the control cable and the control cable housing are flexible, and wherein the control mechanism further comprises:

a hand-held trigger for pulling the control cable axially relative to the control cable housing.

12. The downhill wheeled board of claim 1, wherein the first wheel comprises a hub, and wherein the first brake comprises a brake band mounted for circumferential tightening around the hub upon movement of the force splitter.

13. The downhill wheeled board of claim 1, further comprising:

at least one binding mounted on the top of the platform.

14. The downhill wheeled board of claim 1, and further comprising a fourth wheel, wherein the first wheel and the second wheel are rear wheels and wherein the third wheel and the fourth wheel are front wheels.

15. A downhill wheeled board comprising:

a platform having a top, a bottom and a control cable hole;

at least one binding mounted on the top of the platform;

at least a first wheel, a second wheel, a third wheel and a fourth wheel wherein the first wheel and the second wheel are rear wheels and wherein the third wheel and the fourth wheel are front wheels, each wheel comprising a hub and rotationally mounted to the bottom of the platform for rotation about an axis of rotation;

a first independent suspension for supporting the first wheel such that its axis of rotation can move relative to the bottom of the platform and relative to the second wheel, the first independent suspension comprising:

a first arm pivotally secured relative to the platform, the first arm having a movable end with the first wheel rotationally secured to the moveable end, and shock spring for biasing the first arm toward an extended position;

a second independent suspension for supporting the second wheel such that its axis of rotation can move relative to the bottom of the platform and relative to the first wheel, the second independent suspension comprising:

a second arm pivotally secured relative to the platform, the second arm having a movable end with the second wheel rotationally secured to the moveable end, and a shock spring for biasing the second arm toward an extended position; and a brake system for the downhill wheeled board, the brake system comprising:

a flexible control cable axially movable in a flexible control cable housing, the control cable housing being secured to the platform and wherein the control cable extends through the control cable hole in the platform, a hand-held trigger for pulling the control cable axially relative to the control cable housing, a resting plate spaced below the bottom of the platform, a Y-plate, with the control cable releasably secured to the Y-plate, wherein the Y-plate rests on the resting plate when the brake system is not activated, and when the control cable is pulled to activate the braking system the Y-plate is raised off the resting plate, a first brake cable coupled to the Y-plate in a first brake cable housing secured to the resting plate, wherein the first brake cable and the first brake cable housing are flexible for bending upon movement of the first wheel relative to the bottom of the platform, wherein the first brake cable housing terminates in a block, the block is offset relative to the Y-plate thus forming a permanent bend in the first brake cable, the permanent bend accepting suspension movement of the first wheel without axial tensioning of the first brake cable in the first brake cable housing, a second brake cable coupled to the Y-plate in a second brake cable housing secured to the resting plate, wherein the second brake cable and the second brake cable housing are flexible for bending upon movement of the second wheel relative to the bottom of the platform, wherein the second brake cable housing terminates in a block, the block is offset relative to the Y-plate thus forming a permanent bend in the second brake cable, the permanent bend accepting suspension movement of the second wheel without axial tensioning of the second brake cable in the second brake cable housing, a first brake band for braking the first wheel, the first brake band mounted for circumferential tightening around the hub upon movement of the first brake cable coupled to the Y-plate, wherein the first brake band is secured to the block for suspension movement with the first wheel, and a second brake band for braking the second wheel, the second brake band mounted for circumferential tightening around the hub upon movement of the second brake cable coupled to the Y-plate, such that movement of the Y-plate activates both the first brake band and the second brake band.

16. A brake for a downhill wheeled board having a platform with a first wheel and a second wheel independently suspended from a bottom of the platform, comprising:

a control cable housing, the control cable housing terminating in an attachment mechanism for attachment to the downhill wheeled board;

a control cable axially movable in the control cable housing;

a hand-held trigger for axially moving the control cable in the control cable housing;

a force splitter attached to the control cable for movement by axial movement of the control cable in the control cable housing;

a first brake for braking a first wheel, the first brake coupled to the force splitter by a first brake cable in a first brake cable housing, wherein the first brake cable and the first brake cable housing are flexible for bending upon movement of the first wheel relative to the bottom of the platform with a permanent bend in the first brake cable, the permanent bend accepting suspension movement of the first wheel without axial tensioning of the first brake cable in the first brake cable housing; and a second brake for braking a second wheel, the second brake independently coupled to the force splitter, such that movement of the force splitter activates both the first brake and the second brake.

* * * * *